US006220996B1

(12) United States Patent
McArthur

(10) Patent No.: US 6,220,996 B1
(45) Date of Patent: Apr. 24, 2001

(54) APPARATUS FOR ISOLATING AND EXERCISING THE ABDOMINAL MUSCLES

(75) Inventor: James A. McArthur, Aldergrove (CA)

(73) Assignee: Med-Ex Diagnostics of Canada Inc., Coquitlam (CA)

( * ) Notice: Subject to any disclaimer, the term of this patent is extended or adjusted under 35 U.S.C. 154(b) by 0 days.

(21) Appl. No.: 09/287,481

(22) Filed: Apr. 6, 1999

(30) Foreign Application Priority Data

Jul. 6, 1998 (CA) ..... 2242934

(51) Int. Cl.[7] ..... A63B 21/06
(52) U.S. Cl. ..... 482/142; 482/130; 482/140
(58) Field of Search ..... 482/140, 130, 482/132, 142, 54, 104, 106, 121, 122, 123, 112; D21/662

(56) References Cited

U.S. PATENT DOCUMENTS 3,749,400 * 7/1973 Stoffel .
4,448,412 * 5/1984 Brentham .
5,250,013 * 10/1993 Brangi .

FOREIGN PATENT DOCUMENTS 2185416 7/1987 (GB) .
2262048 6/1993 (GB) .
WO 84/01303A1 4/1984 (WO) .
WO 98/39066 9/1998 (WO) .

* cited by examiner

*Primary Examiner*—Jerome W. Donnelly
(74) *Attorney, Agent, or Firm*—Hall, Priddy, Myers & Vande Sande

(57) ABSTRACT

An apparatus for isolating the abdominal muscles and effectively loading them during exercise is disclosed. The device supports the user's body in a position which allows for trunk flexion; however, it forces the user's knee flexor and hip extensor muscles to contract, relaxing the hip flexor muscle, and isolating the abdominal muscles. Consequently, the only muscles exercised during the trunk flexion are the abdominal muscles.

13 Claims, 6 Drawing Sheets

APPARATUS FOR ISOLATING AND EXERCISING THE ABDOMINAL MUSCLES

FIELD OF THE INVENTION

The present invention relates to an apparatus for isolating the abdominal muscles so as to stabilize the pelvis and lower back during exercise. More specifically, it relates to a device that facilitates trunk flexion exercise (the sit-up motion) without permitting contraction of the hip flexor muscles.

BACKGROUND OF THE INVENTION

The benefits of strong abdominal muscles have long been recognized by sports and physical medicine professionals as well as by the average person. One particular advantage of strong abdominal muscles is the prevention and reduction of associated lower back problems. Traditional methods of exercising the abdominal muscles are not only largely ineffective, but exacerbate most lower back injuries.

The most common exercise for loading the abdominal muscles is trunk flexion, traditionally achieved using the well known sit-up exercise. The sit-up involves the user lying on their back, knees bent and toes hooked under a solid object for stabilization and then raising their torso until they are sitting up. Commonly, several repetitions of the sit-up exercise are performed. Alternatively, a sit-up can be performed using only the weight of the legs for stabilization.

Traditional abdominal exercises (sit-ups) result in trunk flexion being performed by the hip flexor muscles, the same muscles used to raise the knees when walking or stair climbing. The drawback with the traditional sit-up is that the desired motion of the exercise, trunk flexion, is not effected by contraction of the abdominal muscles.

The hip flexor muscles are attached to the pelvic girdle and when they contract a torque is produced about the hip joint. This torque causes the pelvis to tilt forward and flex the trunk. In this position, the lower back is unstable and the resulting shear forces applied to the vertebra cause undesirable stress on the lower back which can cause injury over time. Isometric contraction refers to a type of muscle contraction where the muscles are loaded but no motion occurs (an effect similar to pushing against an immovable object). If sufficiently strong, isometric contraction of the abdominal muscles tends to offset these shear forces placed on the veterbra, thereby stabilizing the lower back.

Accordingly, the principal object of this invention is to provide a means of stabilizing the body during a trunk flexion abdominal exercise in a manner that does not permit the hip flexor muscles to contract, thereby isolating the desired abdominal muscle contraction. Further objects of the invention include providing a means to cause the muscles associated with knee flexion and hip extension to contract, thereby forcing the hip flexors to relax. This helps to stabilize the pelvis (i.e. preventing pelvic tilt) and stabilize the lumbar region of the lower back during trunk flexion and typical upper body weight training exercises.

SUMMARY OF THE INVENTION

The following is a brief description of the invention, its parts and its functionality.

The present invention is a system providing an isolation mechanism operative to isolate a user's abdominal muscles and further to prevent pelvic tilt and stabilize the lower back during exercise. The isolation mechanism comprises a foot support bracket and a frame which supports the bracket. Coupled to the frame is a resistance mechanism, which is operative to resist force applied by the user's feet to the aforementioned foot support bracket and further to contract the user's knee flexor and hip extensor muscles, isolating their abdominal muscles. The device is equipped with an adjustment point which is used to change the orientation of the orthogonal resistance mechanisms for various user body shapes and movements.

In the preferred embodiment, the isolation mechanism may be mounted underneath one end of a bench which supports the user's back and hips while they perform a trunk flexion exercise. The user may place their feet on the foot support bracket of the isolation mechanism and then exert force against the resistance mechanisms. This force applied by the user may be operative to contract the user's knee flexor and hip extensor muscles in a manner which stabilizes their pelvis and lower back during trunk flexion exercise. In this position, the hip flexor muscles cannot be contracted and only the abdominal muscles may be used to perform trunk flexion.

The bench supporting the user may be inclined, declined or curved so as to provide a hyper-extended starting position for the trunk flexion exercise. The bench and isolation mechanism may be adjustable so as to accommodate users with different body sizes and movements.

The resistance mechanisms may be constructed in a variety of styles including tension and compression springs, elastomer materials, air compression means, and even weights and pulleys.

The resistance mechanism may be comprised of a first resistance mechanism oriented in a first direction and a second resistance mechanism oriented in a second direction where the second direction has a component which is orthogonal to the first direction. Both resistance mechanisms are coupled to the frame in a manner which resists forces applied to the foot support bracket by the user's feet. Again the resistance mechanism may be constructed from a variety of styles including tension and compression springs, elastomer materials, air compression means, and even weights and pulleys.

In another aspect of the invention, the isolation mechanism may be mounted underneath one end of a bench which supports the user's back and hips while they perform a typical upper body weight training exercise such as a bench press or dumbbell flies. The user may place their feet on the foot support bracket of the isolation mechanism and then exert force against the resistance mechanisms. This force applied by the user may be operative to contract the user's knee flexor and hip extensor muscles, isolating their abdominal muscles in a manner which stabilizes their pelvis and lower back during the upper body weight training exercise. Again, the bench can be inclined, declined or curved so as to provide a hyper-extended starting position for the trunk flexion exercise. The bench and isolation mechanism may be adjustable so as to accommodate users with different body sizes and movements.

BRIEF DESCRIPTION OF THE DRAWINGS

FIG. 2-*a* displays a tension spring design and FIG. 2-*b* portrays a compression spring design.

FIG. 3 displays a compressed air piston design and FIG. 4 portrays a weight and pulley design.

DESCRIPTION OF THE PREFERRED EMBODIMENT

Figure 1A:
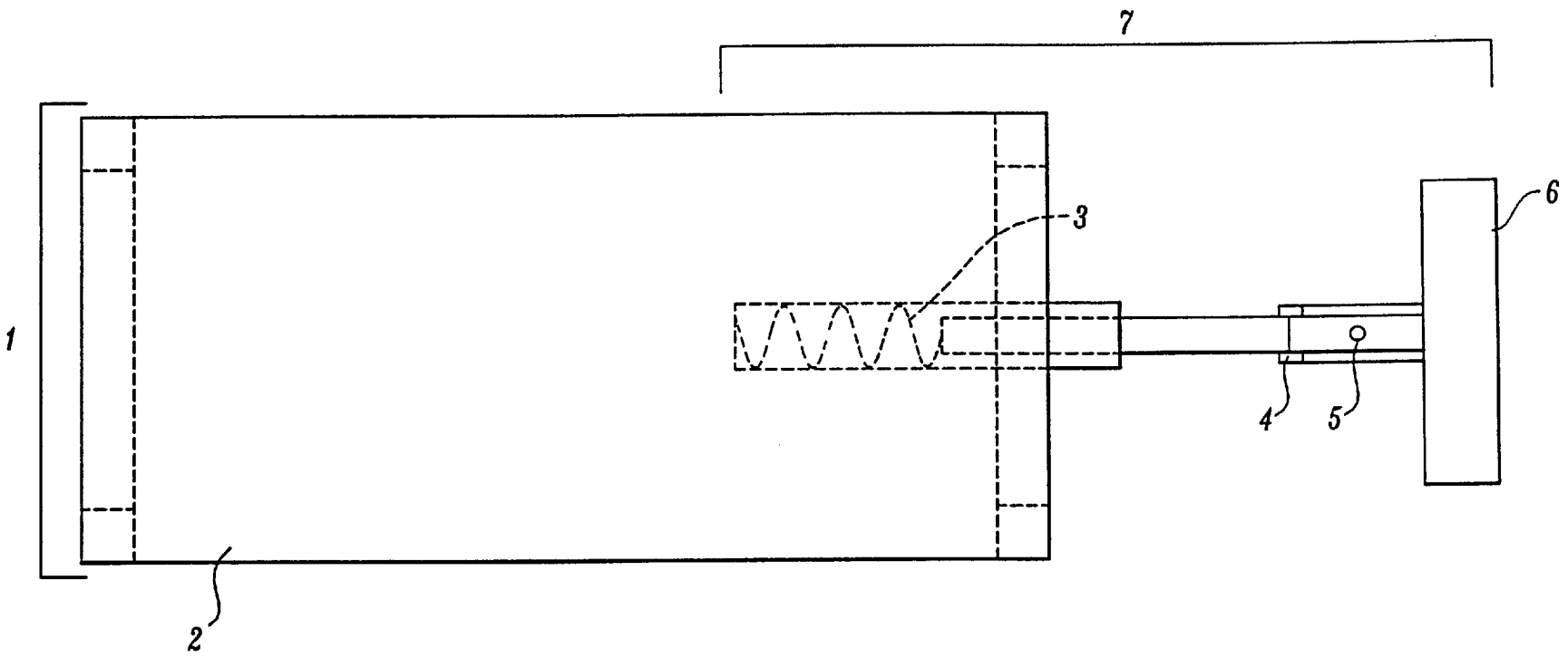
FIGS. 1-*a* and 1*b* show top and side views, respectively, of the apparatus for the preferred embodiment, the side view depicting a person lying on the device and manipulating the isolation mechanism with their feet.
Figure 1B:
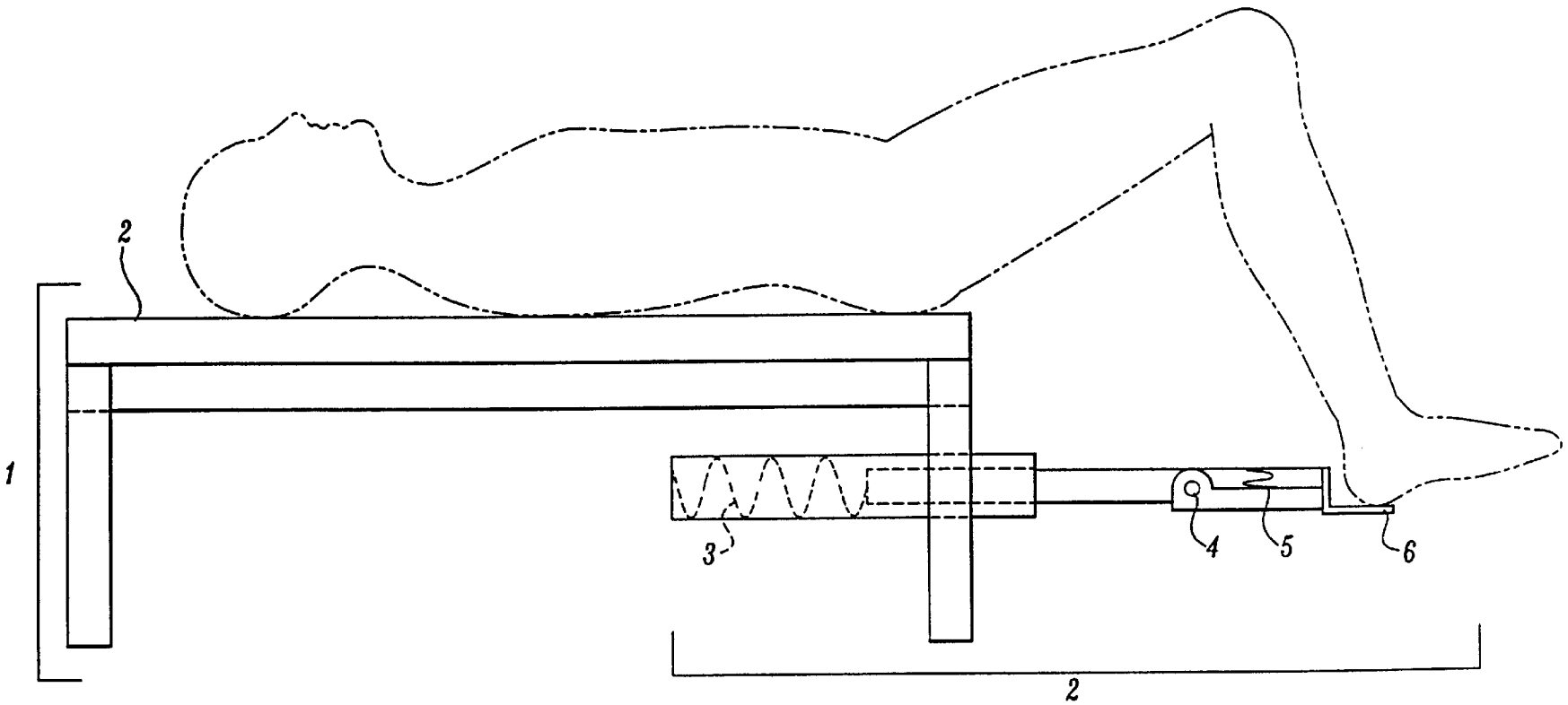

FIGS. 1-*a* and 1-*b* show top and side views, respectively, of the apparatus for the preferred embodiment. Referring to FIGS. 1-*a* and 1-*b*, the device consists of a bench 1 covered by a pad or cushion 2. The user lies on their back atop the bench 1. The bench 1 is equipped with an isolation mechanism 7 affixed underneath one end of the bench 1. The user places their feet in the foot support bracket 6, which has appropriate surfaces for the exertion of force using the posterior of the heels and the soles of the feet. The forces exerted by the user are countered by spring 5 which resists one component of the user applied force and spring 3 which opposes a second component of the user applied force. The isolation mechanism 7 is also provided with a pivot point 4 which permits various orientations for the user applied force. The isolation mechanism 7 and the corresponding user applied forces serve to cause the knee flexor and hip extensor muscles to contract and further cause the hip flexor muscles to relax, effectively isolating the abdominal muscles during trunk flexion.

Figure 2A:
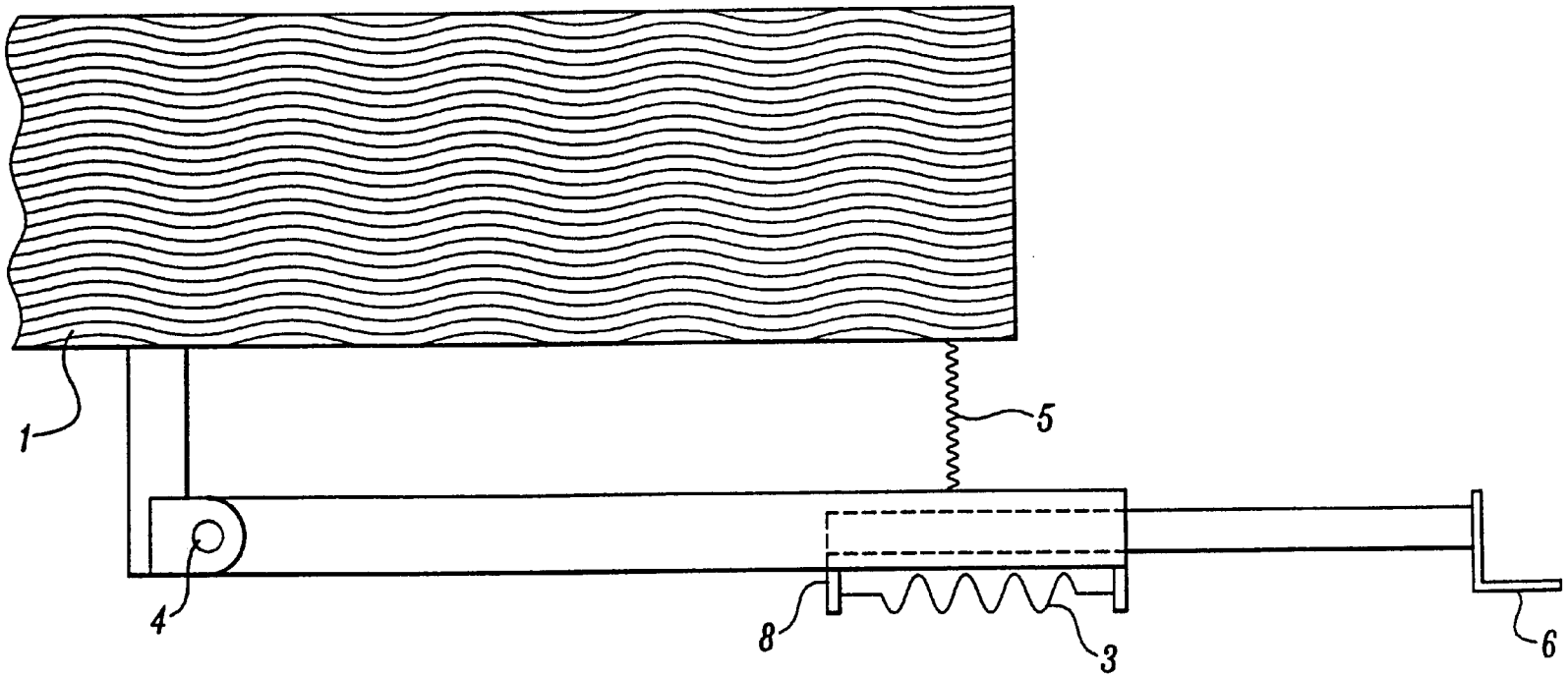
FIG. 2 exhibits detail of two possible embodiments of the isolation mechanism.
Figure 2B:
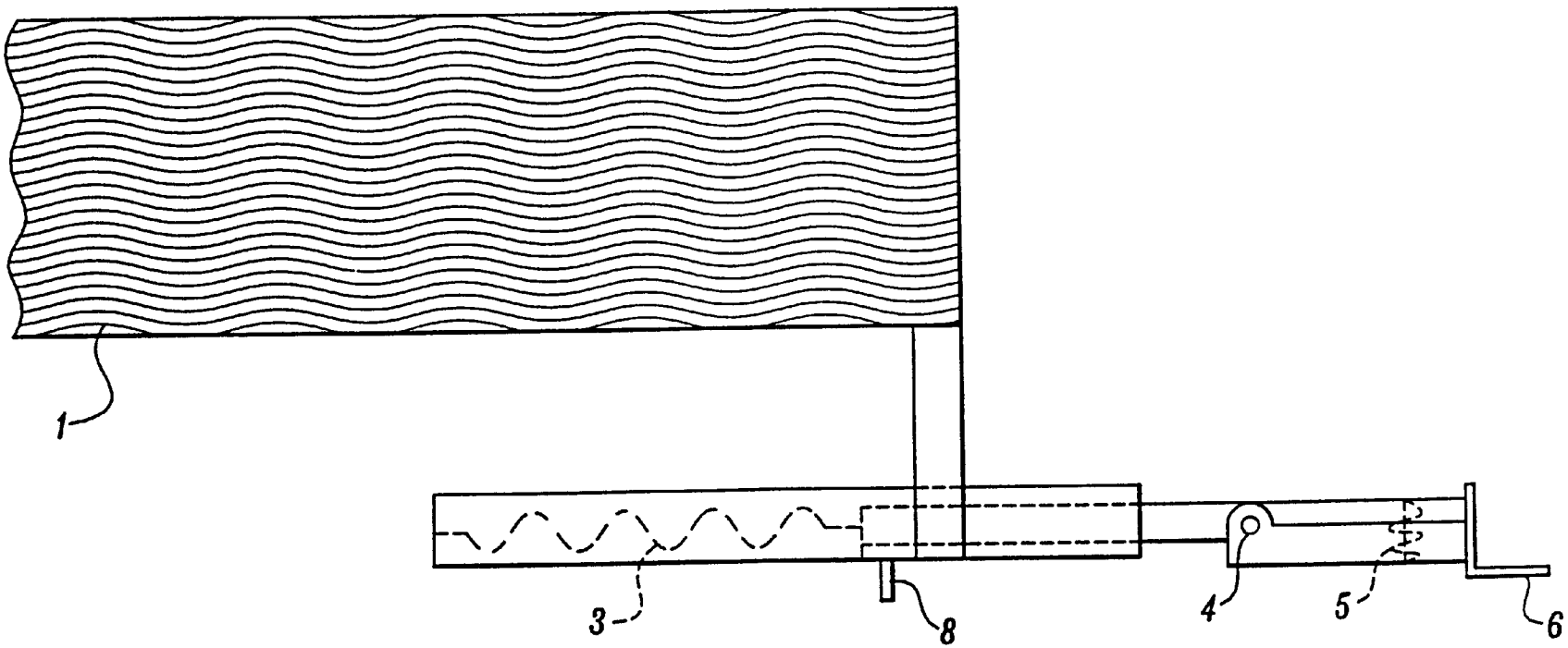

FIG. 2-*a* and FIG. 2-*b* show detail of possible embodiments of the isolation mechanism 7. FIG. 2-*a* depicts a device, wherein the isolation mechanism 7 is implemented using an adjustment point 4 which is distal from the foot support bracket 6. Springs 3 and 5 are tension springs which resist the orthogonal components of the user applied forces. A stroke limiter 8 is provided to control the range of motion of the isolation mechanism 7. FIG. 2-*b* exhibits a device wherein the isolation mechanism 7 is implemented using an adjustment point 4 which is closer to the foot support bracket 6. Spring 5 is once again a tension spring which resists one component of the user applied force, and spring 3 is a compression spring which resists a second component of the user applied force. The device is also equipped with a stroke limiter 8 as in FIG. 2-*a*.

Figure 3:
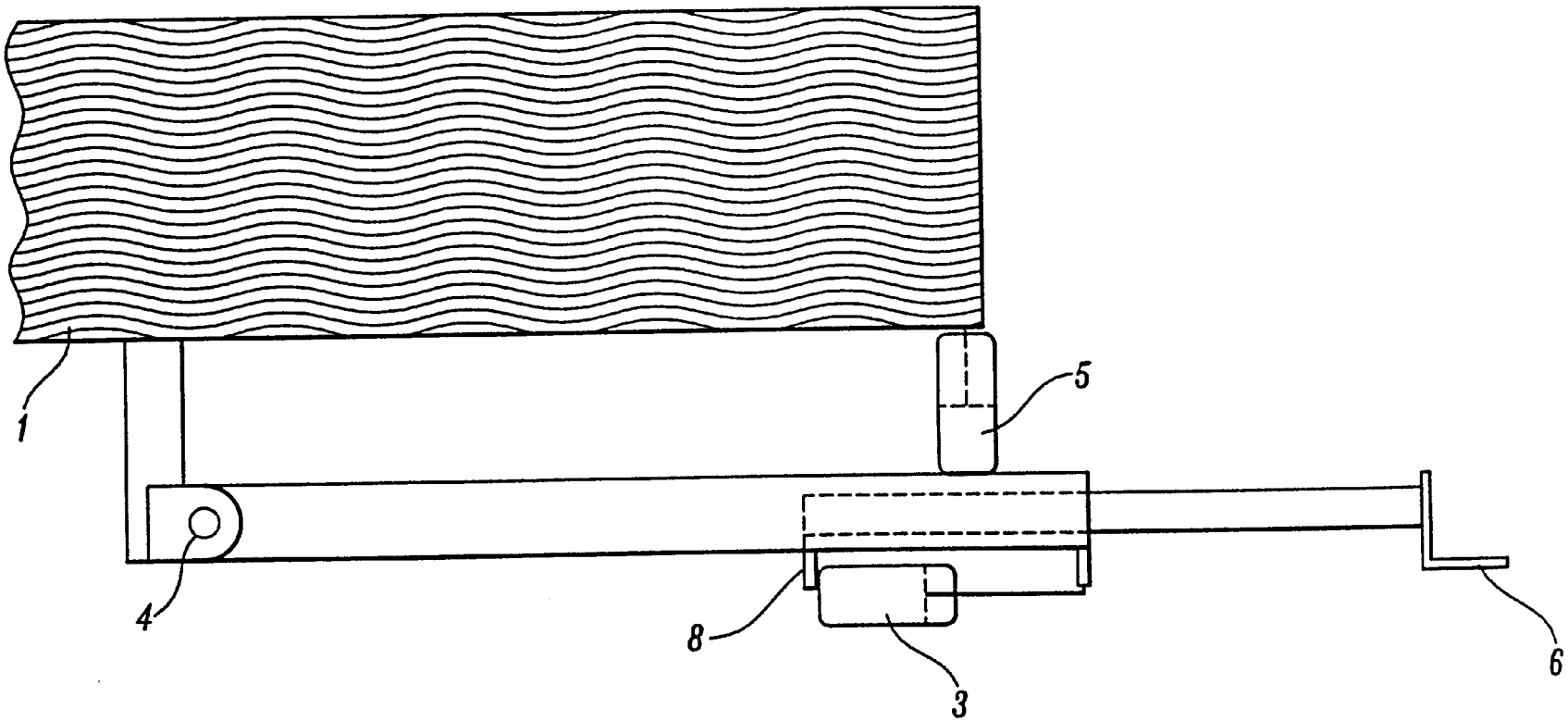
FIG. 3 and FIG. 4 exhibit detail of other possible embodiments of the isolation mechanism.
Figure 4:
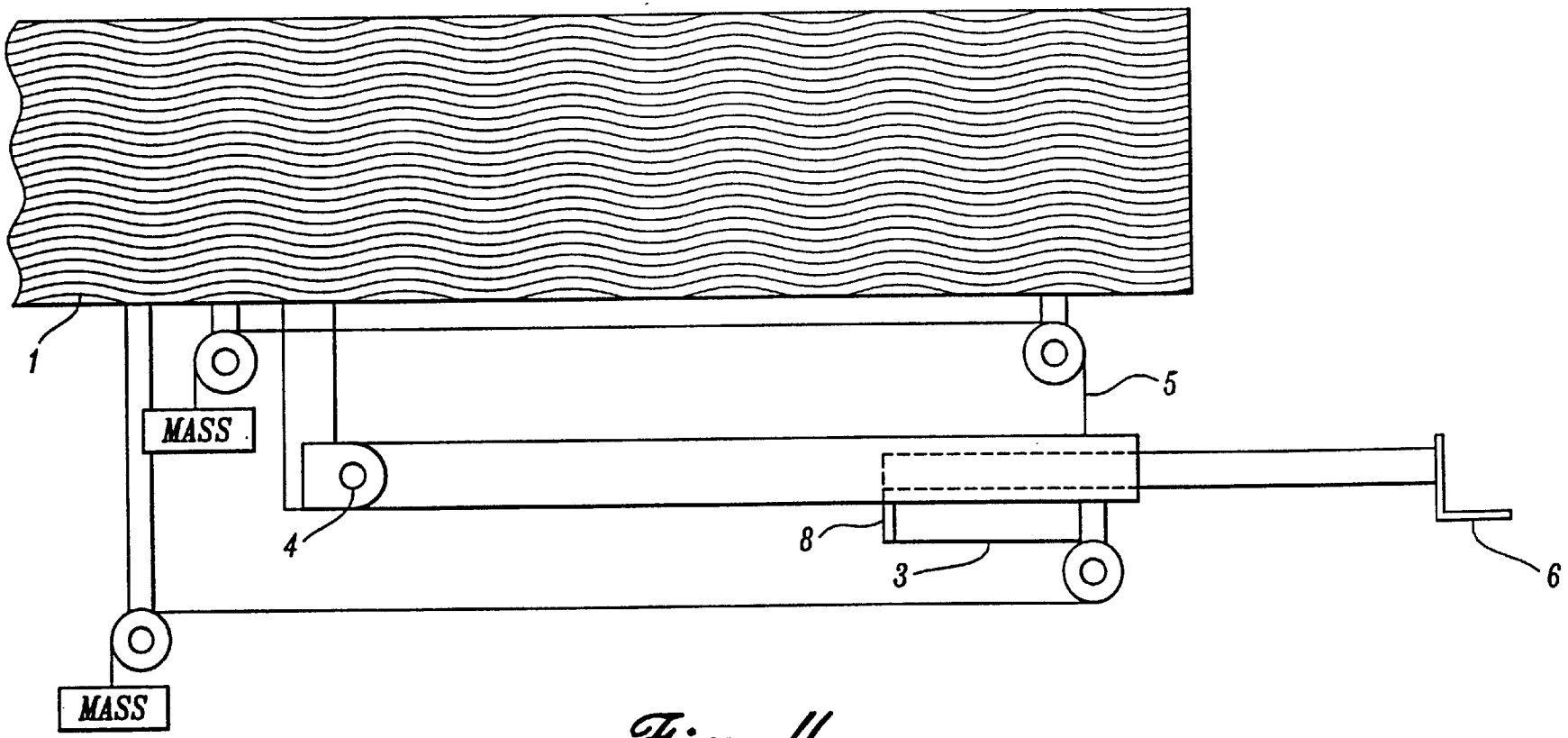

Many other possible embodiments exist which are not shown in the drawings. The bench 1 may be designed to incline, decline or curve the user's body to provide various starting positions. Furthermore, the resistance mechanism may be accomplished by means other than springs, including weights and pulleys, compressed air, and elastomer materials. FIG. 3 and FIG. 4 depict compressed air piston and weight and pulley designs.

What is claimed is:

1. An apparatus for an isolation mechanism operative to isolate a user's abdominal muscles and further to prevent pelvic tilt and stabilize the lower back during exercise, said isolation mechanism comprising:

(a) a foot support bracket;

(b) a frame providing support for said foot support bracket;

(c) a resistances mechanism comprised of:

(i) a first resistance mechanism, coupled to said frame, operative to supply resistance in a first direction against forces applied to said foot support bracket by said user's feet; and (ii) a second resistance mechanism, coupled to said frame, operative to supply resistance in a second direction against forces applied to said foot support bracket by said user's feet, said second direction having a component orthogonal to said first direction; and (d) an adjustment point, coupled to said frame, operative to adjust the position of said foot support bracket so as to accommodate different users and body movement during said exercise.

2. An apparatus according to claim 1, wherein said first and second resistance mechanisms are constructed using springs.

3. An apparatus according to claim 1, wherein said first and second resistance mechanisms are constructed using compressed air.

4. An apparatus according to claim 1, wherein said first and second resistance mechanisms are constructed using a weight and pulley arrangement.

5. An apparatus according to claim 1, wherein said resistance mechanism is constructed using springs.

6. An apparatus according to claim 1, wherein said resistance mechanism is constructed using compressed air.

7. An apparatus according to claim 1, wherein said resistance mechanism is constructed using a weight and pulley arrangement.

8. A trunk flexion exercise apparatus comprising:

(a) a bench operative to support said user's back and hips during said trek flexion exercise; and (b) an isolation mechanism mounted under one end of said bench, said isolation mechanism further comprising:

(i) a foot support bracket;

(ii) a frame providing support for said foot support bracket;

(iii) a resistance mechanism comprised of:

a first resistance mechanism, coupled to said frame, operative to supply resistance in a first direction against forces applied to said foot support bracket by said user's feet; and (bb) a second retistance mechanism, coupled to said frame, operative to supply resistance in a second direction against forces applied to said foot support bracket by said user's feet, said second direction having a component orthogonal to said first direction; and (iv) an adjustment point, coupled to said frame, operative to adjust the position of said foot support bracket so as to accommodate different users and body movement during said exercise;

said isolation mechanism is operative to simultaneously contract said user's knee flexor and hip extensor muscles, isolating said user's abdominal muscles in a manner which stabilizes said user's pelvis and lower back during said trunk flexion exercise.

9. An apparatus according to claim 8, wherein said bench is one of inclined, declined or curved so as to provide a hyper-extended starting position for said trunk flexion exercise.

10. An apparatus according to claim 8, wherein said bench and said isolation mechanism are adjustable so as to accommodate users with different body sizes and movements.

11. An upper body weight training exercise apparatus comprising:

(a) a bench operative to support said user's back and hips during said upper body weight training exercise; and (b) an isolation mechanism mounted under one end of said bench, which isolation mechanism further comprising:

(i) a foot support bracket;

(ii) a frame providing support for said foot support bracket;

(iii) a resistance mechanism comprised of:

(aa) a first resistance mechanism, coupled to said frame, operative to supply resistance in a first direction against forces applied to said foot support bracket by user's feet; and (bb) a second resistance mechanism, coupled to said frame, operative to supply resistance in a second direction against forces applied to said foot support bracket by said user's feet, said second direction having a component orthogonal to said first direction; and (iv) an adjustment point, coupled to said frame, operative to adjust the position of said foot support bracket so as to accommodate different users and body movement during said exercise;

said isolation mechanism operative to simultaneously contract said user's knee flexor and hip extensor muscles, isolating said user's abdominal muscles in a manner which stabilizes said user's pelvis and lower back during said upper body weight training exercise.

12. An apparatus according to claim 11, wherein said bench is one of inclined, declined or curved so as to provide a modified upper body weight training exercise.

13. An apparatus according to claim 11, wherein said bench and said isolation mechanism are adjustable so as to accommodate users with different body sizes and movements.

* * * * *